US010712014B2

(12) United States Patent
Dusky

(10) Patent No.: US 10,712,014 B2
(45) Date of Patent: Jul. 14, 2020

(54) MODULAR LINEAR FIREPLACE GAS BURNER SYSTEM

(71) Applicant: Paul Dusky, Greenbrier, TN (US)

(72) Inventor: Paul Dusky, Greenbrier, TN (US)

(73) Assignee: EARTHCORE INDUSTRIES, LLC, Jacksonville, FL (US)

( * ) Notice: Subject to any disclaimer, the term of this patent is extended or adjusted under 35 U.S.C. 154(b) by 229 days.

(21) Appl. No.: 15/901,092

(22) Filed: Feb. 21, 2018

(65) Prior Publication Data

US 2019/0257523 A1 Aug. 22, 2019

(51) Int. Cl.

| | |
|---|---|
| ***F24B 1/199*** | (2006.01) |
| ***F24C 3/00*** | (2006.01) |
| ***F24B 1/18*** | (2006.01) |

(52) U.S. Cl.

CPC ..... *F24C 3/006* (2013.01); *F24B 1/18* (2013.01); *F24B 1/199* (2013.01)

(58) Field of Classification Search

CPC ..... F23D 2900/14641; F23D 14/14; F23D 14/145; F23D 14/16; B67D 2210/0006; B67D 2210/00062; F24C 3/12; F24C 3/006; F24C 3/002; F23K 5/005; F23K 5/007; F23K 2203/10; F16L 3/1025; F16L 37/00; F16L 21/06; F16L 25/12; F24B 1/18; F24B 1/199

USPC ..... 126/39 N

See application file for complete search history.

(56) References Cited

U.S. PATENT DOCUMENTS 1,518,577 A * 12/1924 Enright ..... F23D 14/04 431/347
1,637,772 A * 8/1927 Heckel ..... F23D 14/36 431/162
1,642,153 A * 9/1927 Wallace ..... F23D 14/10 431/180
1,689,798 A * 10/1928 Nieberding ..... F23D 14/04 126/92 AC
1,751,095 A * 3/1930 Moore ..... F24C 3/027 126/39 B
1,863,100 A * 6/1932 Coleman ..... F23D 14/045 239/407
1,952,682 A * 3/1934 Powers ..... F23D 11/08 431/180
2,005,801 A * 6/1935 Olsen ..... F23D 14/48 431/349
2,081,657 A * 5/1937 Douglass ..... F23D 14/60 431/347
2,116,096 A * 5/1938 Caldwell ..... F23N 1/022 431/12

(Continued)

FOREIGN PATENT DOCUMENTS

DE 102008055994 B4 * 9/2010 ..... G07F 13/025
FR 1492997 A 8/1967

*Primary Examiner* — Jorge A Pereiro
(74) *Attorney, Agent, or Firm* — Thomas C. Saitta

(57) ABSTRACT

A modular linear fireplace gas burner system having a plurality of interconnectable pipe modules and one or more burner members of varying length, each said pipe module having a pipe segment, spuds, orifice mounting blocks and mounting brackets to retain one of more of the burner members, wherein the distance D(o) between adjacent spuds on each pipe segment is equal and for joined pipe segments the distance D(c) between the outermost spud of one pipe segment to the outermost spud of the other pipe segment is equal to D(o).

20 Claims, 5 Drawing Sheets

(56) References Cited

U.S. PATENT DOCUMENTS 2,134,972 A * 11/1938 Haney ..... F23D 14/045 431/347
2,168,758 A * 8/1939 Bellamy ..... 431/347
2,185,886 A * 1/1940 Caldwell ..... F23D 14/04 239/417
2,185,903 A * 1/1940 Stein, Sr. ..... 431/347
2,316,140 A * 4/1943 Skeen ..... F16L 21/025 48/190
2,450,744 A * 10/1948 Whitehead ..... F24C 3/085 126/39 N
2,560,888 A * 7/1951 Reed ..... F23D 14/125 431/347
2,569,514 A * 10/1951 Burklin ..... F23D 14/64 431/355
2,592,911 A * 4/1952 Ketelsen ..... F23D 14/08 431/181
2,594,914 A * 4/1952 Frederick ..... F23D 14/125 431/347
2,598,961 A * 6/1952 Andrus ..... A01G 25/02 137/883
2,625,992 A * 1/1953 Beck ..... F23D 14/045 431/283
3,003,227 A * 10/1961 Haag ..... B21C 37/296 29/890.08
3,021,893 A * 2/1962 Guido ..... F23D 14/145 431/329
3,056,616 A * 10/1962 Jaros ..... F16L 19/0225 285/148.23
3,136,354 A * 6/1964 Fitzgerald ..... F23D 14/125 431/286
3,199,570 A * 8/1965 Williams ..... F23D 14/125 431/329
3,304,985 A * 2/1967 Kitchener ..... F23D 14/12 431/68
3,407,023 A * 10/1968 Hirschberg ..... F23D 14/48 431/328
3,602,480 A * 8/1971 Demi ..... F16L 41/12 251/146
3,694,137 A * 9/1972 Fichter ..... F23D 14/08 431/283
3,746,308 A * 7/1973 Vatterott ..... F16L 41/08 251/145
3,750,247 A * 8/1973 Demi ..... F16L 41/12 29/890.141
3,794,013 A * 2/1974 Upton ..... A47J 37/0682 126/40
3,824,064 A * 7/1974 Bratko ..... F23D 14/16 431/328
3,843,309 A * 10/1974 Lambiris ..... F23B 5/00 431/284
3,881,858 A * 5/1975 Fitzgerald ..... F23C 99/00 431/348
4,065,248 A * 12/1977 Straitz, III ..... F23G 7/08 431/202
4,088,436 A * 5/1978 Alferes ..... F16L 37/23 137/517
4,156,591 A * 5/1979 Anderson ..... F23D 14/64 239/567
4,311,328 A * 1/1982 Truchet ..... F16L 37/22 285/308
4,613,112 A * 9/1986 Phlipot ..... F16L 37/22 137/71
4,628,900 A * 12/1986 Arndt ..... F24C 15/24 126/92 AC
4,737,100 A * 4/1988 Schnell ..... F23D 14/20 239/288
4,870,993 A * 10/1989 Casuso ..... F24C 3/12 137/883
5,116,400 A * 5/1992 Abbott ..... C03B 37/0142 65/144
5,172,723 A * 12/1992 Sturgis ..... F16L 37/23 137/613
5,211,732 A * 5/1993 Abbott ..... C03B 37/0142 65/421
5,540,250 A * 7/1996 Mullins ..... F16L 55/1015 137/75
5,788,290 A * 8/1998 Meisinger ..... F16L 37/1215 137/614.06
7,600,536 B1 * 10/2009 Steininger ..... F16L 41/03 137/882
8,327,879 B2 * 12/2012 Ellis ..... F16K 27/003 137/271
10,480,823 B2 * 11/2019 Noman ..... F24H 3/065
2002/0195820 A1 * 12/2002 Surjaatmadja ..... F16L 27/0861 285/373
2003/0025326 A1 * 2/2003 Schulte ..... F16L 37/0841 285/316
2004/0194834 A1 * 10/2004 Rehder ..... F16K 27/003 137/625.27
2008/0202493 A1 * 8/2008 Dettloff ..... F24C 3/12 126/39 B
2009/0061373 A1 * 3/2009 Bannos ..... F23D 14/12 431/347
2010/0159410 A1 * 6/2010 Hwang ..... F23D 14/02 431/354
2011/0041831 A1 * 2/2011 Dettloff ..... F24C 3/12 126/39 B
2011/0220219 A1 * 9/2011 Ellis ..... F16K 27/003 137/15.21
2011/0220224 A1 * 9/2011 Ellis ..... F16L 41/03 137/561 A
2012/0228871 A1 * 9/2012 Li ..... E03C 1/021 285/307
2013/0288187 A1 * 10/2013 Imgrundt ..... F23D 14/26 431/258
2014/0116558 A1 * 5/2014 Gonzalez Martinez ..... F23K 5/007 138/106
2015/0253037 A1 9/2015 Rumens et al.
2018/0347809 A1 * 12/2018 Heilskov ..... F23D 14/14

* cited by examiner

MODULAR LINEAR FIREPLACE GAS BURNER SYSTEM

BACKGROUND OF THE INVENTION

This application relates generally to the field of gas burner systems of the type used in ornamental fireplaces. More particularly, the invention relates to modular systems comprising multiple lengths of connected gas pipes and multiple gas orifices.

Residential and commercial ornamental fireplaces having flames produced by the burning of natural gas or propane are well known. The fireplace gas burner systems comprise one or more pipes that deliver gas from a gas supply source, such as a public utility gas line or a gas storage tank, through one or more orifices and into one or more burner devices, the burner members producing multiple flames of varying heights and widths spread out across various patterns and distances. With some fireplaces, artificial logs sets known as fireplace inserts are created wherein the gas pipe and orifices are positioned within or between artificial logs. When the gas is ignited, the flames combined with the artificial logs simulate the look of an actual wood fire. In other fireplaces, multiple orifices and/or one or more burner members are arranged in a row such that the bare flames appear above artificial embers or similar heat-stable members to create the desired decorative appearance, one popular style being commonly referred to as a linear fireplace.

As linear fireplaces have no standard length, the linear gas burner system will vary in length, which presents a problem to manufacturers in that the linear gas burner systems must either be custom manufactured or a large number of linear gas burner systems of different lengths must be manufactured and stocked. In addition, the burner members must be manufactured such that the openings which receive the orifices are properly spaced to match the spacing of the orifices in the gas pipe.

It is an object of this invention to provide a modular linear fireplace gas burner system which addresses the problems and shortcomings inherent in the current systems, wherein the modular linear fireplace gas burner system is structured and designed such that multiple pipe modules having pipe segments of varying lengths may be connected to create a combined linear pipe of differing lengths as required for a given installation, wherein the orifices are consistently spaced such that a single separation distance is defined between each adjacent orifice, whether the adjacent orifices are both situated on a single pipe segment or whether the adjacent orifices span the connector fittings joining together two pipe segments. It is a further object to provide such a system wherein the connector fittings joining adjacent pipe modules, preferably quick-connect fittings, define a bore having an inner diameter smaller than the inner diameter of the pipe segments, such that a Venturi-effect is created between each pipe module to increase the flow rate of the gas through the pipe segments and to equalize pressure within the system.

SUMMARY OF THE INVENTION

The invention in various embodiments is a modular linear fireplace gas burner system comprising a plurality of interconnectable pipe modules and burner members of varying length wherein the pipe modules and burner members may be joined to form linear fireplace gas burner systems of different lengths. Each pipe module comprises a pipe segment having a male and a female connector fitting, preferably of the quick-connect type, a plurality of equally spaced spuds extending radially from the pipe segment, at least one orifice mounting block associated with and connected to at least one spud, and an orifice associated with and connected to each mounting block. A cap is associated with and connected to any of the spuds that are not associated with an orifice mounting block and orifice. Multiple pipe modules are joined end-to-end, with one outermost pipe segment adapted to be joined to a gas supply pipe and the other outermost pipe segment being sealed at its free, unconnected end.

In this manner gas flows through the pipe segments, the spuds, orifice mounting blocks and orifices into burner members that are associated with and connected to mounting brackets on the orifice mounting blocks, the burner members having openings corresponding to the orifices to receive the gas such that ignition of the gas flowing from the burner members produces flames of desired, pattern, shape, spacing and the like, as determined by the location, size and shape of apertures or slits disposed in the upper surfaces of the burner members. A single burner member or multiple burner members may be utilized in a particular system, and a single burner member may receive gas from one or multiple orifices.

The connector fittings are chosen such that the internal diameter of at least a portion of the bore within the passageway defined by the combined connector fittings of adjoined pipe segments is smaller than the internal diameter of the pipe segments. This creates a Venturi-effect, i.e., the fluid pressure is reduced when the gas flows through the constricted section, such that the gas flow rate through the pipe segments is increased, which serves to equalize pressure throughout the pipe modules.

The spacing of the spuds along the pipe segments is critical to maximize the modular efficacy and universal application of the system. Adjacent spuds on a given pipe segment are all equally spaced. The length of the pipe segment extending from each outermost spud is determined in conjunction with the chosen connector fittings such that with a first pipe segment joined to a second pipe segment, the distance between the adjacent outermost spuds of the first and second pipe segments is equal to the distance between the adjacent spuds on any single pipe segment. With this structure adjacent spuds and therefore the associated orifices will always be separated by the same distance, allowing the burner members to be structured to mate with the combined pipe segments even when pipe segments of differing lengths are utilized to form the complete system.

Alternatively, the invention in various embodiments may be summarized and described as a modular linear gas burner system comprising: a plurality of interconnectable pipe modules, each said pipe module comprising a pipe segment, connector fittings adapted to join one said pipe segment to another said pipe segment, spuds mounted on each of said pipe segments, orifice mounting blocks connected to one or more of said spuds, and orifices mounted to each of said orifice mounting blocks; one or more burner members connected to one or more of said pipe modules; wherein the distance between adjacent said spuds on all said pipe segments is equal, and wherein for first and second said pipe segments joined together by said connector fittings, the distance between the outermost said spud of said first pipe segment to the outermost said spud of said second pipe segment is equal to the distance between adjacent said spuds on each of said first and second pipe segments. Furthermore, wherein each said pipe segment comprises a bore having an internal diameter, and wherein the combination of said connector fittings joining one said pipe segment to another said pipe segment defines a bore having an internal diameter smaller than the internal diameters of said pipe segment bores; wherein said pipe modules further comprise mounting brackets connected to said orifice mounting blocks, said one or more burner members is connected to said one or more said pipe modules by said mounting brackets; and/or wherein said connector fittings are quick-connect fittings.

Alternatively, the invention in various embodiments may be summarized and described as a modular linear gas burner system comprising: a plurality of interconnectable pipe modules, each said pipe module comprising a pipe segment, connector fittings adapted to join one said pipe segment to another said pipe segment, spuds mounted on each of said pipe segments, orifice mounting blocks connected to one or more of said spuds, and orifices mounted to each of said orifice mounting blocks; one or more burner members connected to one or more of said pipe modules; wherein the distance between each adjacent set of said spuds on each of said pipe segments defines a single distance D(o), and wherein for first and second said pipe segments joined together by said connector fittings, the distance between the outermost said spud of said first pipe segment to the outermost said spud of said second pipe segment defines a distance D(c) which is equal to distance D(o). Furthermore, wherein each said pipe segment comprises a bore having an internal diameter, and wherein the combination of said connector fittings joining one said pipe segment to another said pipe segment defines a bore having an internal diameter smaller than the internal diameters of said pipe segment bores; wherein said pipe modules further comprise mounting brackets connected to said orifice mounting blocks, said one or more burner members is connected to said one or more said pipe modules by said mounting brackets; and/or wherein said connector fittings are quick-connect fittings.

Alternatively, the invention in various embodiments may be summarized and described as a modular linear gas burner system comprising: a plurality of interconnectable pipe modules, each said pipe module comprising a pipe segment, connector fittings adapted to join one said pipe segment to another said pipe segment, spuds mounted on each of said pipe segments, orifice mounting blocks connected to one or more of said spuds, and orifices mounted to each of said orifice mounting blocks; one or more burner members connected to one or more of said pipe modules; wherein the distance between each adjacent set of said spuds on each of said pipe segments defines a single distance D(o), and wherein for first and second said pipe segments joined together by said connector fittings, the combination of said connector fittings defines an artificial midpoint A(m) between the outermost said spud of said first pipe segment and the outermost said spud of said second pipe segment, and wherein the distance from each of said outermost said spuds to said midpoint A(m) is equal to half the distance D(o). Furthermore, wherein each said pipe segment comprises a bore having an internal diameter, and wherein the combination of said connector fittings joining one said pipe segment to another said pipe segment defines a bore having an internal diameter smaller than the internal diameters of said pipe segment bores; wherein said pipe modules further comprise mounting brackets connected to said orifice mounting blocks, said one or more burner members is connected to said one or more said pipe modules by said mounting brackets; and/or wherein said connector fittings are quick-connect fittings.

DETAILED DESCRIPTION OF THE INVENTION

Figure 1:
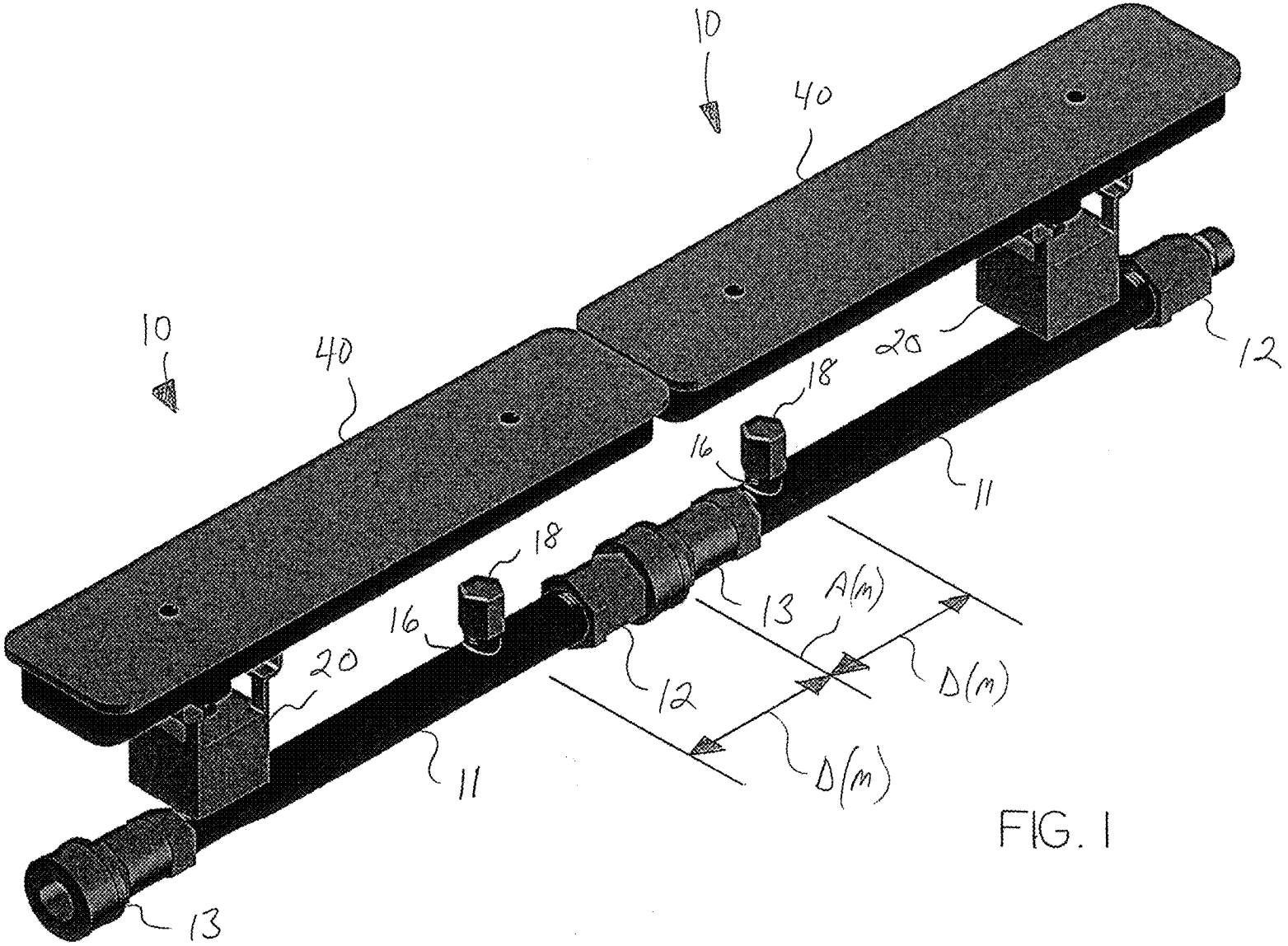
FIG. 1 is perspective view of a representative embodiment of the invention showing a modular system having two linearly connected gas pipe modules with gas pipe segments of the same length and two associated burner members.

The invention in various embodiments will now be described, with reference to the drawings, which are provided for illustrative and descriptive purposes and are not meant to limiting as the scope and definition of the invention. In general, the invention in various embodiments is a modular linear fireplace gas burner system comprising a plurality of interconnectable pipe modules 10 and burner members 40 of varying length wherein the pipe modules 10 and burner members 40 may be joined to form linear fireplace gas burner systems of different lengths. Each pipe module 10 comprises a pipe segment 11 having a male and a female connector fitting 12/13, preferably of the quick-connect type, a plurality of equally spaced spuds 16 extending radially from the pipe segment 11, at least one orifice mounting block 20 associated with and connected to at least one spud 16, and an orifice 30 associated with and connected to each orifice mounting block 20. A cap 18 is associated with and connected to any of the spuds 16 that are not associated with an orifice mounting block 20 and orifice 30. Multiple pipe modules 10 are joined end-to-end, with one outermost pipe segment 11 adapted to be joined to a gas supply pipe (not shown) and the other outermost pipe segment 11 being sealed by a cap or plug on its free, unconnected end (not shown).

The pipe segments 11 are linear tubular conduits formed of a rigid material suitable for the transport of natural gas, propane or similar combustible fuels. The pipe segment 11 has a longitudinal bore with a defined internal diameter 14. Each pipe segment 11 is structured so as to be connectable to another pipe segment 11 in end-to-end manner. Preferably, each pipe segment 11 is provided with a male connector fitting 12 joined to one end and a female connector fitting 13 joined to the other end. The connector fittings 12/13 are preferably of a quick-connect type such that assembly of the modular linear fireplace gas burner system is easily and quickly accomplished. For example, in the embodiments shown in the drawings, one end of the pipe segment 11 may be externally threaded to receive an internally threaded male connector 12 and the other end of the pipe segment 11 may be externally threaded to receive an internally threaded female connector 13.

Figure 3:
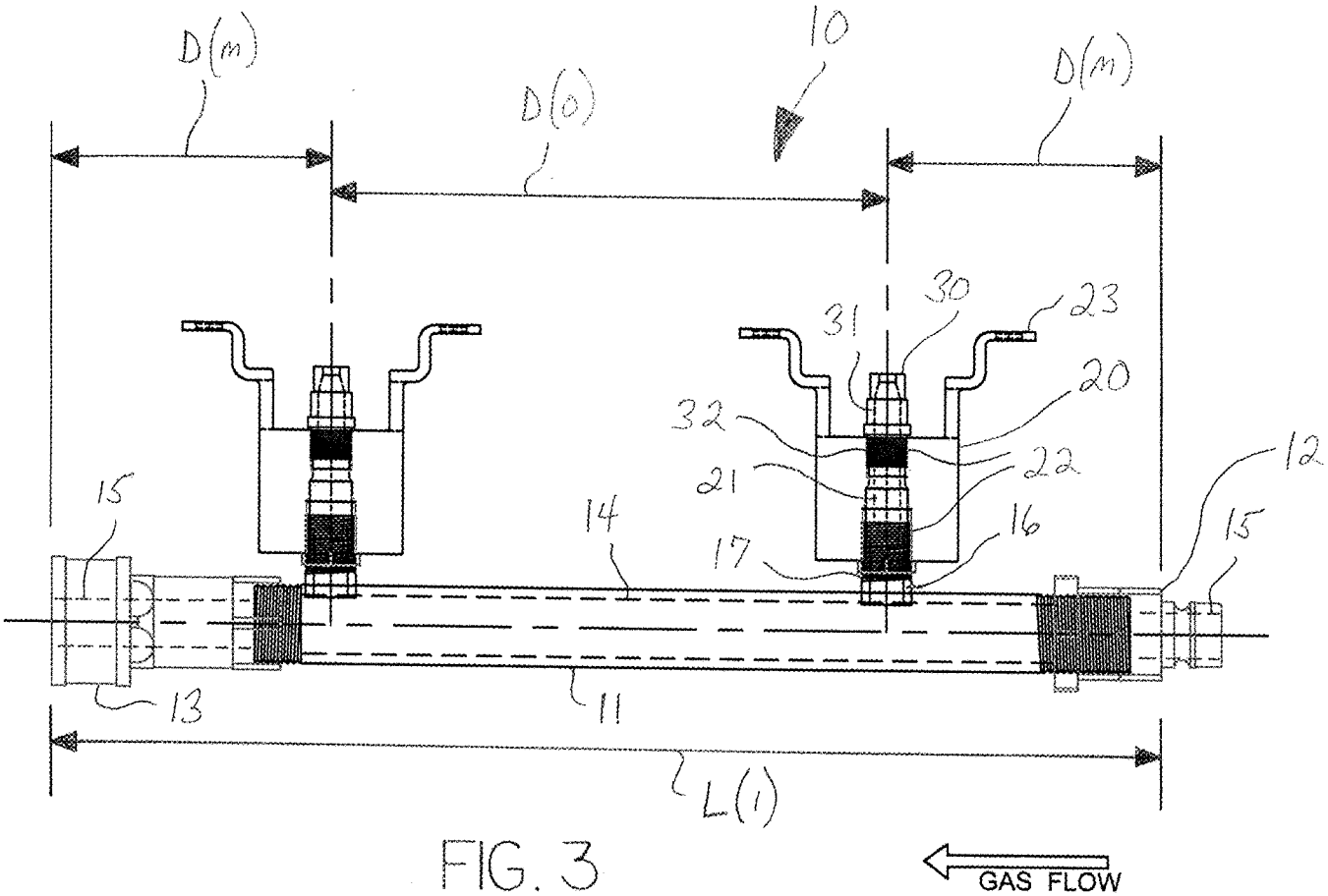
FIG. 3 is a plan view of a representative embodiment of the invention showing a gas pipe module having a short gas pipe segment with two equally spaced spuds.
Figure 4:
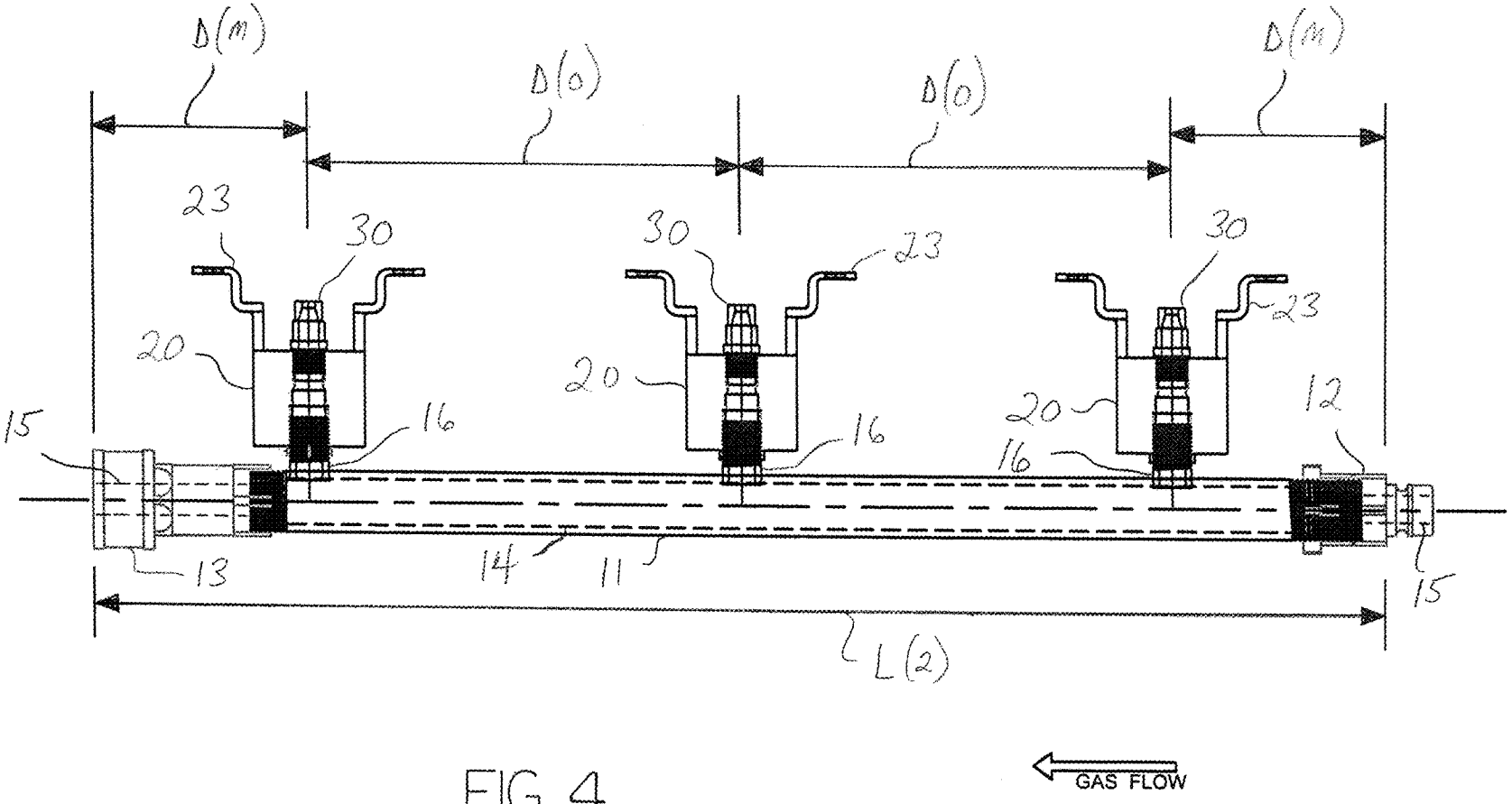
FIG. 4 is a plan view of a representative embodiment of the invention showing a gas pipe module having a longer gas pipe segment, relative to the gas pipe segment embodied in FIG. 3, with three equally spaced spuds.
Figure 5:
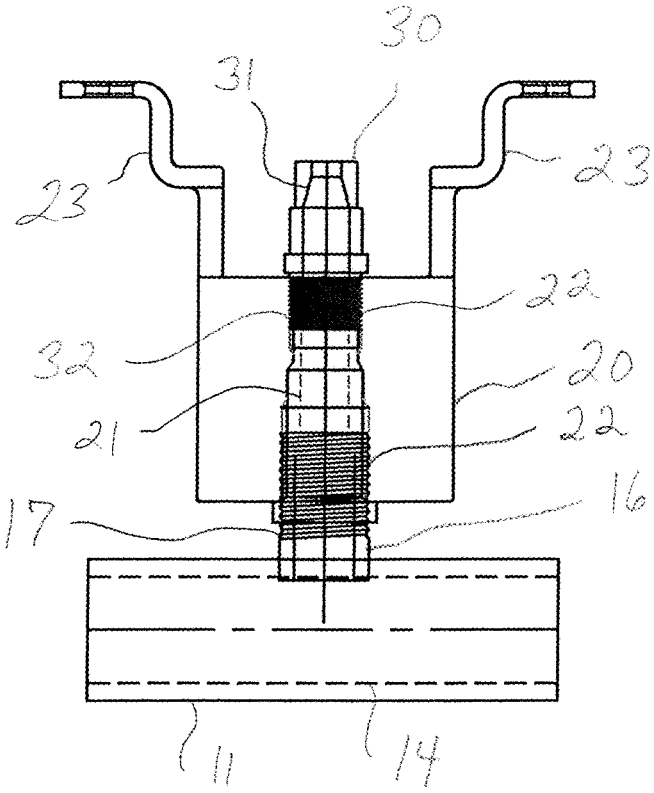
FIG. 5 is an enlarged view of a spud, orifice mounting block and orifice as shown in the embodiments of FIGS. 3 and 4.

The connector fittings 12/13 are chosen such that the internal diameter 15 of at least a portion of the bore 15 within the passageway defined by the combined connector fittings 12/13 has an internal diameter smaller than the internal diameter of the bores 14 of the adjoining pipe segments 11, as seen in FIGS. 3 and 4. This creates a Venturi-effect, i.e., the fluid pressure is reduced when the gas flows through the constricted section of the connector fittings 12/13, such that the gas flow rate through the pipe segments 11 is increased, which serves to equalize pressure throughout the pipe modules 10. For example, for a pipe segment 11 having a bore 14 with an internal diameter 14 of one inch, the internal diameter 15 of bore 15 defined by the connector fittings 12/13 may be ⅜ inch.

The spuds 16 are tubular members welded or otherwise connected to the pipe segment in fluid communicating manner such that gas flowing through the pipe segment 11 exits through the spuds 16. The orifice mounting blocks 20 connect to the spuds 16, preferably in a removable manner. For example, as shown in the drawings, the spuds 16 may be provided with external threading 17 and the orifice mounting blocks 20 provided with an internal bore 21 having corresponding internal threading 22 at its lower end for mating with a spud 16. Appropriately sized internally threaded caps 18 are provided such that a spud 16 may be sealed when an orifice mounting block 20 is not connected the spud 16. The height and other dimensions of the spuds 16 may vary.

The orifices 30 are nozzle members comprising bores 31 to expel or direct the gas flow in a desired and controlled manner. The orifices 30 and orifice mounting blocks 20 are structured to be connectable in a manner whereby gas can flow from the spud 16 through the orifice mounting block 20 and out the orifice 30. The orifice 30 and orifice mounting block 20 are preferably connected in a manner that allows for easy disconnection for assembly, replacement or exchange. For example, as shown in the drawings, the lower end of the orifice bore 31 may be provided with external threading 32 and the upper end of the orifice mounting block bore 21 provided with internal threading 21, both sized to allow for proper mating. The upper portion of the orifice mounting block 20 is provided with mounting brackets 23 to receive a burner member 40 in secure manner, such as with mechanical fasteners. The mounting brackets 23 may be joined to the orifice mounting blocks 20 in any suitable manner, such as by welding, mechanical fasteners, etc., or may be formed integrally with the orifice mounting block 20 as a single structure.

Figure 2:
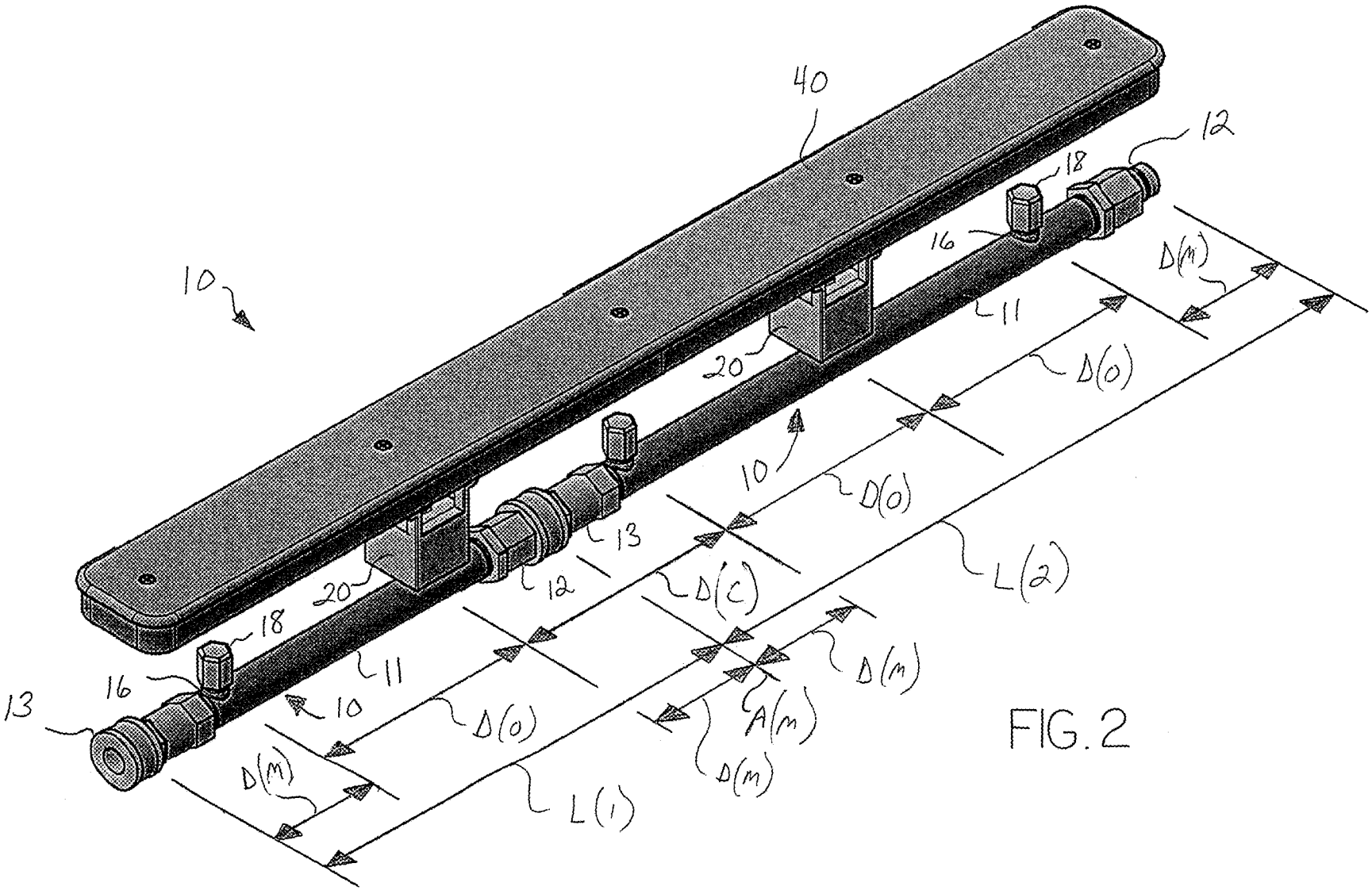
FIG. 2 is perspective view of another representative embodiment of the invention showing a modular system having two linearly connected gas pipe modules with gas pipe segments of differing lengths and a single burner member associated with both gas pipe modules.

The spacing of the spuds 16 along the pipe segments 11 is critical to maximize the modular efficacy and universal application of the modular linear fireplace gas burner system. Adjacent spuds 16 on a given pipe segment 11 are all equally spaced by a distance D(o), as shown best in FIGS. 2 and 4 (distances being measured to the center of each spud 16). The length of the pipe segment 11 extending from each outermost spud 16 is determined in conjunction with the chosen connector fittings 12/13 such that with a first pipe segment 11 joined to a second pipe segment 11, the distance D(c) between the adjacent outermost spuds 16 of the first and second pipe segments 11 is equal to the distance D(o) between the adjacent spuds 16 on any single pipe segment 11 as seen in FIG. 2. In alternative terms, the length of the pipe segment 11 extending from each outermost spud 16 in conjunction with the chosen connector fittings 12/13 defines an artificial midpoint A(m), such that the distance D(m) from an outermost spud 16 to the artificial midpoint A(m) located in the combined connector fittings 12/13 is half the distance D(o).

Thus, for example as illustrated in FIG. 4, for a pipe module 10 having a length L(2) of eighteen inches (excluding the portion of the male connector 12 that is received within the female connector 13), the distance D(o) between three spuds 16 is six inches and the distance D(m) from the outermost spuds 16 to the artificial midpoints A(m) is three inches. As illustrated in FIG. 3, for a pipe module 10 having a length L(1) of twelve inches, the distance D(o) between two spuds 16 is six inches and, since the two spuds 16 are also the outermost spuds 16, the distance D(m) will be three inches. In this manner, when two twelve inch pipe modules 10 are joined, as shown in FIG. 1, or two eighteen inch pipe modules 10 are joined, or one twelve inch pipe module 10 and one eighteen inch pipe module 10 are joined, as shown in FIG. 2, distance D(m) plus distance D(m), which is distance D(c), equals distance D(o).

With this structure adjacent spuds 16 and therefore the associated orifices 30 will always be separated by the same distance (D(o) or D(c)), allowing the burner member 40 to be structured to mate with the combined pipe segments 11 even when pipe segments 11 of differing lengths are utilized to form the complete system. This is accomplished by providing the burner members 40, which may be round, square, oblong, triangular, or diamond shaped, or be pan-style sheet metal burner members 40, as shown in the drawings, with lower openings corresponding to the separation distances D(o) and D(c) of the spuds 16, such that the lower burner member openings will correspond to the locations of the orifices 30.

Gas flows through the pipe segments 11 and the spuds 16 having orifice mounting blocks 20 and orifices 30 mounted thereon, and into the openings of the burner members 40 that are associated with and connected to mounting brackets 23 on the orifice mounting blocks 20, such that ignition of the gas flowing into and from the burner members 40 produces flames of desired, pattern, shape, spacing and the like, as determined by the location, size and shape of apertures or slits disposed in the upper surfaces of the burner members 40. A single burner member 40 or multiple burner members 40 may be utilized in a particular system, and a single burner member 40 may receive gas from one or multiple orifices 30 on one or multiple pipe segments 11. The modular linear gas burner system is thereby scalable to multiple distances by proper choice of pipe segment 11 lengths. Different styles of burner members 40 are interchangeable, as all burner members 40 will be compatible with some of the equally spaced orifices 30, the remaining orifices 30 being capped when not in use.

It is understood that equivalents and substitutions for certain elements set forth above may be obvious to those of skill in the art, and therefore the true scope and definition of the invention is to be as set forth in the following claims.

I claim:

1. A modular linear gas burner system comprising:

a plurality of interconnectable pipe modules, each said pipe module comprising a pipe segment, connector fittings adapted to join one said pipe segment to another said pipe segment, spuds mounted on each of said pipe segments, orifice mounting blocks connected to one or more of said spuds, and orifices mounted to each of said orifice mounting blocks;

one or more burner members connected to one or more of said pipe modules;

wherein each of said orifice mounting blocks comprises a bore, such that for each of said orifice mounting blocks, gas flows through one of said spuds into said bore of said orifice mounting block, then flows through said bore of said orifice mounting block into said orifice mounted to said orifice mounting block, and then through said orifice into one of said burner members;

wherein the distance between adjacent said spuds on all said pipe segments is equal, and wherein for first and second said pipe segments joined together by said connector fittings, the distance between the spuds immediately adjacent coupled connector fittings is equal to the distance between adjacent said spuds on each of said first and second pipe segments.

2. The system of claim 1, wherein each said pipe segment comprises a bore having an internal diameter, and wherein the combination of said connector fittings joining one said pipe segment to another said pipe segment defines a bore having an internal diameter smaller than the internal diameters of said pipe segment bores.

3. The system of claim 1, wherein said pipe modules further comprise mounting brackets connected to said orifice mounting blocks, said one or more burner members is connected to said one or more said pipe modules by said mounting brackets.

4. The system of claim 1, wherein said connector fittings are quick-connect fittings.

5. The system of claim 1, wherein said spuds and said orifice mounting blocks are threaded, such that said orifice mounting blocks are threadingly connected to said spuds.

6. The system of claim 1, further comprising threaded caps, wherein said threaded caps are mounted to any of said spuds not connected to an orifice mounting block.

7. A modular linear gas burner system comprising:

a plurality of interconnectable pipe modules, each said pipe module comprising a pipe segment, connector fittings adapted to join one said pipe segment to another said pipe segment, spuds mounted on each of said pipe segments, orifice mounting blocks connected to one or more of said spuds, and orifices mounted to each of said orifice mounting blocks;

one or more burner members connected to one or more of said pipe modules such that gas flows from said orifices directly into said one or more burner members;

wherein each of said orifice mounting blocks comprises a bore, and wherein the bore of each said orifice mounting block defines a gas flowpath between one of said spuds into one of said orifices;

wherein the distance between each adjacent set of said spuds on each of said pipe segments defines a single distance D(o), and wherein for first and second said pipe segments joined together by said connector fittings, the distance between the spuds immediately adjacent coupled connector fittings defines a distance D(c) which is equal to distance D(o).

8. The system of claim 7, wherein each said pipe segment comprises a bore having an internal diameter, and wherein the combination of said connector fittings joining one said pipe segment to another said pipe segment defines a bore having an internal diameter smaller than the internal diameters of said pipe segment bores.

9. The system of claim 7, wherein said pipe modules further comprise mounting brackets connected to said orifice mounting blocks, said one or more burner members is connected to said one or more said pipe modules by said mounting brackets.

10. The system of claim 7, wherein said connector fittings are quick-connect fittings.

11. The system of claim 7, wherein said spuds and said orifice mounting blocks are threaded, such that said orifice mounting blocks are threadingly connected to said spuds.

12. The system of claim 7, further comprising threaded caps, wherein said threaded caps are mounted to any of said spuds not connected to an orifice mounting block.

13. A modular linear gas burner system comprising:

a plurality of interconnectable pipe modules, each said pipe module comprising a pipe segment, connector fittings adapted to join one said pipe segment to another said pipe segment, spuds mounted on each of said pipe segments, orifice mounting blocks connected to one or more of said spuds, and orifices mounted to each of said orifice mounting blocks;

one or more burner members connected to one or more of said pipe modules such that gas flows from said orifices directly into said one or more burner members;

wherein each of said orifice mounting blocks comprises a bore, and wherein the bore of each said orifice mounting block defines a gas flowpath between one of said spuds into one of said orifices;

wherein the distance between each adjacent set of said spuds on each of said pipe segments defines a single distance D(o), and wherein for first and second said pipe segments joined together by said connector fittings, the combination of said connector fittings defines an artificial midpoint A(m) between the outermost said spud of said first pipe segment and the outermost said spud of said second pipe segment, and wherein the distance from each of said outermost said spuds to said midpoint A(m) is equal to half the distance D(o).

14. The system of claim 13, wherein each said pipe segment comprises a bore having an internal diameter, and wherein the combination of said connector fittings joining one said pipe segment to another said pipe segment defines a bore having an internal diameter smaller than the internal diameters of said pipe segment bores.

15. The system of claim 13, wherein said pipe modules further comprise mounting brackets connected to said orifice mounting blocks, said one or more burner members is connected to said one or more said pipe modules by said mounting brackets.

16. The system of claim 13, wherein said connector fittings are quick-connect fittings.

17. The system of claim 14, wherein said connector fittings are quick-connect fittings.

18. The system of claim 17, wherein said pipe modules further comprise mounting brackets connected to said orifice mounting blocks, said one or more burner members is connected to said one or more said pipe modules by said mounting brackets.

19. The system of claim 13, wherein said spuds and said orifice mounting blocks are threaded, such that said orifice mounting blocks are threadingly connected to said spuds.

20. The system of claim 13, further comprising threaded caps, wherein said threaded caps are mounted to any of said spuds not connected to an orifice mounting block.

* * * * *